US005758576A

United States Patent [19]

Mack et al.

[11] Patent Number: 5,758,576

[45] Date of Patent: Jun. 2, 1998

[54] GRIPPER BAR FOR DELIVERIES OF PRINTING PRESSES

[75] Inventors: Richard Mack, Brühl; Martin Mayer, Ladenburg; Michael Voge, Malsch; Norbert Thünker, Hirschberg; Roland Hirth, Römberg; Bernd Maul, Heidelberg, all of Germany

[73] Assignee: Heidelberger Druckmaschinen AG, Heidelberg, Germany

[21] Appl. No.: 681,820

[22] Filed: Jul. 29, 1996

[30] Foreign Application Priority Data

Jul. 27, 1995 [DE] Germany ..... 195 27 439.3

[51] Int. Cl.[6] ..... B41F 1/30

[52] U.S. Cl. ..... 101/408; 271/204

[58] Field of Search ..... 101/408, 409, 101/232; 271/204, 205, 82, 85, 268, 277

[56] References Cited

U.S. PATENT DOCUMENTS

| | | | |
|---|---|---|---|
| 3,924,849 | 12/1975 | Murakami | 271/277 |
| 4,058,307 | 11/1977 | Bubley et al. | 271/85 |
| 4,470,593 | 9/1984 | Halff et al. | 271/277 |
| 4,530,495 | 7/1985 | Zimmermann et al. | 271/204 |
| 4,693,362 | 9/1987 | Kemmerer et al. | 198/803.7 |
| 4,886,260 | 12/1989 | Reist | 271/315 |
| 5,056,773 | 10/1991 | Weisgerber | 271/204 |
| 5,125,640 | 6/1992 | Yerly et al. | 271/204 |
| 5,303,650 | 4/1994 | Wieland | 101/409 |

FOREIGN PATENT DOCUMENTS

| | | | |
|---|---|---|---|
| 211 760 | 7/1984 | German Dem. Rep. . | |
| 1014558 | 8/1957 | Germany | 101/408 |
| 2 140 442 | 3/1972 | Germany . | |
| 307 955 | 10/1969 | Sweden | 101/408 |
| 357747 | 12/1961 | Switzerland . | |
| 2 191 175 | 12/1987 | United Kingdom . | |

*Primary Examiner*—Edgar S. Burr
*Assistant Examiner*—Dave A. Ghatt
*Attorney, Agent, or Firm*—Herbert L. Lerner; Laurence A. Greenberg

[57] ABSTRACT

Gripper bar for a delivery of a printing press, the gripper bar being carried at respective ends thereof by transport chains and having a multiplicity of grippers with gripper fingers for transporting sheets includes a hollow profiled member having a boxlike profile wherein a gripper shaft is receivable, the boxlike profiled member being formed with lateral openings through which the gripper fingers of the grippers extend.

6 Claims, 3 Drawing Sheets

GRIPPER BAR FOR DELIVERIES OF PRINTING PRESSES

BACKGROUND OF THE INVENTION

Field of the Invention

The invention relates to a gripper bar for deliveries of printing presses, the gripper bar being carried at the ends thereof by transport or conveyor chains, having many grippers for sheet transport, and being formed as a hollow profile.

Printing presses are equipped with deliveries for delivering sheets on a sheet pile. As a rule, these deliveries have, on side walls thereof, two synchronously traveling chains carrying gripper bars. These gripper bars are equipped with many grippers, which take the sheet from the printing press and deposit it onto the sheet pile. Such gripper bars must have a given stability for effecting a clean sheet acceptance and deposition. In particular, they must be embodied with bending and torsional rigidity.

From the published European Patent Document EP 0 189 828 B1, a gripper bar of the type referred to at the introduction hereto is known, wherein the base body includes an integrally cast steel pipe. Although such a gripper bar has very great stability, nevertheless, the weight thereof is high because of the heavy steel pipe. Moreover, the concentration of mass is not optimal for attaining high bending rigidity and high stability with respect to torsional strains. The grippers cannot be disposed centrally in the base body of the gripper bar, with the consequence that very large lever arms are required on the grippers, so that very great forces are exerted and very great spacings are necessary. This in turn increases the mass of the gripper bar, with the consequence that more material is used, greater forces act upon the chains, there is greater inertia, and the bar has a greater height. This latter factor, in turn, means that dryers and powder devices are located farther away from the path of the printing material and can therefore not function as effectively.

SUMMARY OF THE INVENTION

It is accordingly an object of the invention to provide a gripper bar for deliveries of printing presses which is optimized in terms of weight, height, bending rigidity and torsional rigidity.

With the foregoing and other objects in view, there is provided, in accordance with the invention, a gripper bar for a delivery of a printing press, the gripper bar being carried at respective ends thereof by transport chains and having a multiplicity of grippers with gripper fingers for transporting sheets, comprising a hollow profiled member having a boxlike profile wherein a gripper shaft is receivable, the boxlike profiled member being formed with lateral openings through which the gripper fingers of the grippers extend.

In accordance with another feature of the invention, the grippers have gripper pads disposed on an upper side of the hollow profiled member.

In accordance with a further feature of the invention, the hollow profiled member is formed with thickened walls in a vicinity of the gripper pads and in a region located opposite thereto.

In accordance with an added feature of the invention, the hollow profiled member is formed with varying wall thicknesses over the length thereof, in accordance with forces incident thereat.

In accordance with an additional feature of the invention, the wall thickness of the hollow profiled member is thinner in the middle of the gripper bar than in the vicinity of the ends thereof.

In accordance with yet another feature of the invention, the hollow profiled member has at least one transverse wall formed with a through-bore therein for a gripper shaft.

In accordance with yet a further feature of the invention, the hollow profiled member has, at the ends thereof, shell-like flanges to which connecting elements for connecting the gripper bar to the transport chains are attached, and the gripper bar includes bearings for the gripper shaft received in the shell-like flanges.

In accordance with a concomitant feature of the invention, the hollow profiled member is formed with lateral openings for assembly and adjustment work.

By means of the aforedescribed embodiment of the base body of the gripper bar as a boxlike hollow profile, the material can be concentrated at the location where it furnishes optimal stability. In particular, the material can be concentrated in regions of high tensile and compressive forces. In this way, high bending and torsional rigidity is attained at relatively low weight. The grippers are located centrally in the hollow profile and, as a result, short lever arms, low forces and smaller spacings can be achieved than in the gripper bar of the prior art described at the introduction hereto. Because of the lower weight, less powerful forces act upon the chains, so that the chains can be slighter in dimension, or greater stability is attained. The drive requires less powerful forces as well, and the inertia is reduced. A smaller structural height is possible and, as a result, dryers and a powder device can be brought closer to the path of the printing material and, hence, can work with less loss.

A further feature provides that gripper pads be located on the upper side of the hollow profile. A result thereof is that those portions of the gripper bridge at which high forces occur are located in a region which has especially high bending rigidity. Further optimization is possible in that the hollow profile is formed with thicker walls in the vicinity of the gripper pads, and in a region located opposite thereto. Consequently, the material of the hollow profile is disposed at locations of high forces, which in turn serves to optimize the ratio between weight and rigidity.

A suitable further feature provides that the hollow profile, viewed over the length thereof, has varying wall thicknesses, formed in accordance with the incident forces thereat. As a result, optimization of the material which is used can be accomplished with respect to the length of the gripper bar, as well, so that an even lighter-weight bar can be produced. For example, the wall thickness of the hollow profile may be formed thinner in the middle of the gripper bar than in the vicinity of the ends of the bar.

Provision may be made for the hollow profile to have at least one transverse wall, which is pierced by a bore for receiving he gripper shaft therein. By means of such transverse walls, a further increase in torsional rigidity can be attained, if that is desired for a particular type of machine, such as a printing press, particularly. The gripper shaft extends or is passed through the bore and can also be additionally supported therein, for the purpose of providing it with better stability.

An advantageous further feature provides for the hollow profile to have, at the ends thereof, shell-like flanges to which connecting elements are attached for connecting the gripper bar to the transport chains, the shell-like flanges receiving bearings for the gripper shaft therein. Such shell-like flanges are especially stable and provide good absorption of the relatively high forces existing at the suspension of the gripper bar. The shell-like flanges also provide the space for stably supporting roller levers which serve to actuate the grippers.

A further feature provides that the hollow profile be formed with openings for mounting and adjustment work. In this way, assembling the gripper bar and adjusting the individual grippers are facilitated.

Other features which are considered as characteristic for the invention are set forth in the appended claims.

Although the invention is illustrated and described herein as embodied in a gripper bar for deliveries of printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
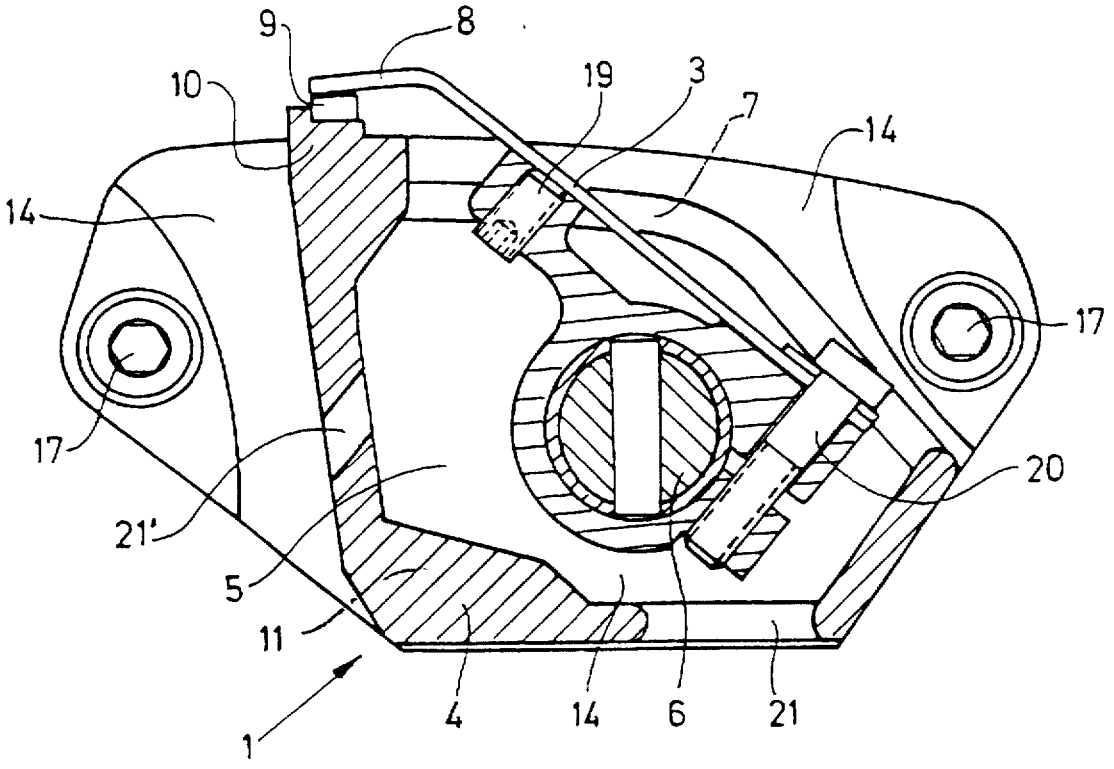
FIG. 1 is a cross-sectional view of a gripper bar according to the invention provided with grippers.

Referring now to the drawings and, first, particularly to FIG. 1 thereof, there is shown therein, in a cross-sectional view, a gripper bar 1 with a gripper 3. The cross-sectional plane shows the boxlike hollow profile 4, in the interior 5 of which the gripper shaft 6 having the grippers 3 is supported. The hollow profile 4 is formed of one material, for example, as a cast part. Preferably, a lightweight material with high stability is used, such as an aluminum alloy. The bearing support of the gripper shaft 6 is provided at least on both sides of the hollow profile 4, in shell-like flanges 14 disposed thereat; these flanges 14 have walls extending transversely to the hollow profile 4 and serving to provide this bearing support, and increasing the overall stability. Additional transverse walls 12 may, however, also be inserted, wherein the gripper shaft 6 can likewise be supported. The hollow profile 4 has gripper pads 9 at the upper side thereof which cooperate with gripper fingers 8 when gripping and holding a sheet. To attain high stability, the region 10 of the hollow profile 4, which is located at the gripper pads 9, and an oppositely located region 11 are embodied with thick walls. This achieves especially high bending rigidity of the hollow profile 4 and uses as little material as possible, which contributes to a lighter construction of the gripper bar 1. In the region of the grippers 3, openings 7 are provided through which the gripper fingers 8 pass so as to be able to grasp the sheets. Openings 21 and 21' are also formed in the region of the gripper 3, to permit ready access to the gripper 3 for assembly and adjustment work. For example, the opening 21 serves to enable adjustment of an adjusting screw 19 for the gripper fingers 8 by means of a suitable tool. The shell-like flanges 14 at the end of the hollow profile 4 have threaded fasteners 17, which serve to fasten connecting elements 15 by which the gripper bar 1 is connected to the transport or conveyor chains 2. A screw or bolt 20 is also shown for fastening the gripper 3 to the gripper shaft 6.

Figure 2:
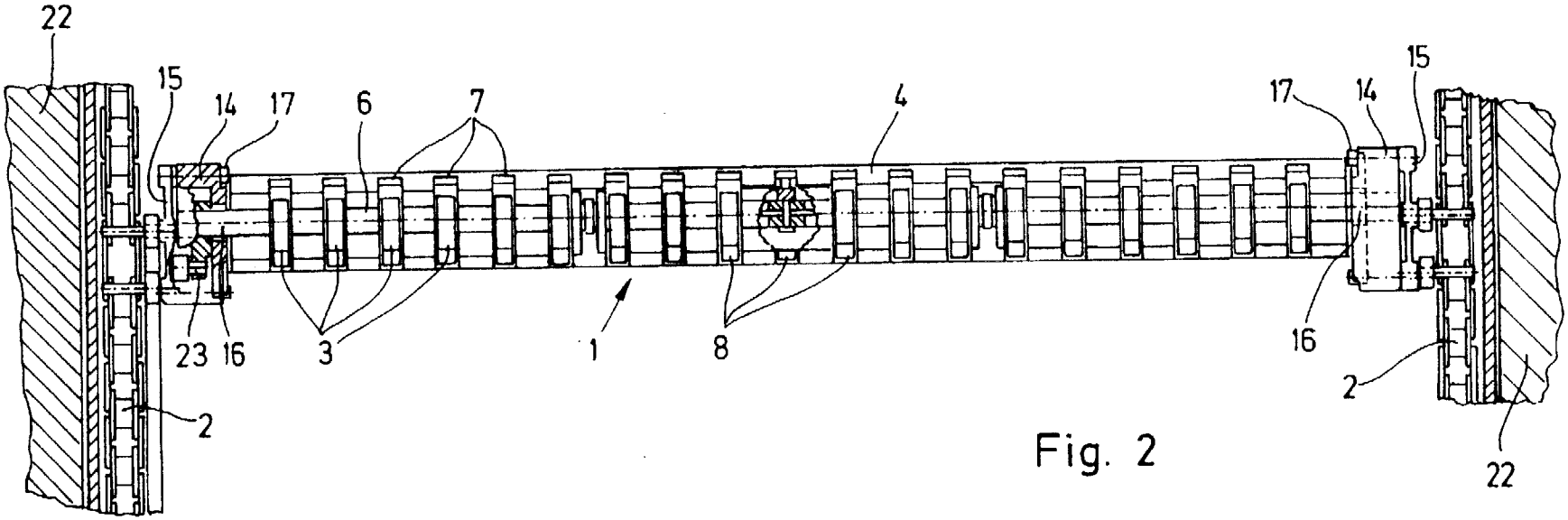
FIG. 2 is a longitudinal top plan view of an installed gripper bar suspended from respective conveyor chains.

FIG. 2 shows the suspension of a gripper bar 1 installed in the delivery. Two transport or conveyor chains 2 revolve along the side walls 22 of the delivery, and at least one gripper bar 1 but, as a rule, a plurality of gripper bars 1 are fastened to these chains 2. This fastening is accomplished by connecting elements 15, which are joined by means of screw fastenings 17 to the shell-like flanges 14 of the gripper bar 1.

Located in the interior of the hollow profile 4 of the gripper bar 1 is the gripper shaft 6, which is supported by means of bearings 16 at least in the transverse walls of the shell-like flanges 14. However, a further bearing in one or more transverse walls 12 is also possible. For each gripper 3, the hollow profile 4 has one opening 7 through which the gripper fingers 8 pass so that they can cooperate with the gripper pads 9. In one of the shell-like flanges 14, there is a roller lever 23, which cooperates with a cam in order to actuate the grippers 3. The holding or retention force of the grippers 3 is applied by means of a torsion spring and is cancelled by means of the roller lever 23 so that a sheet can be deposited.

Figure 3:
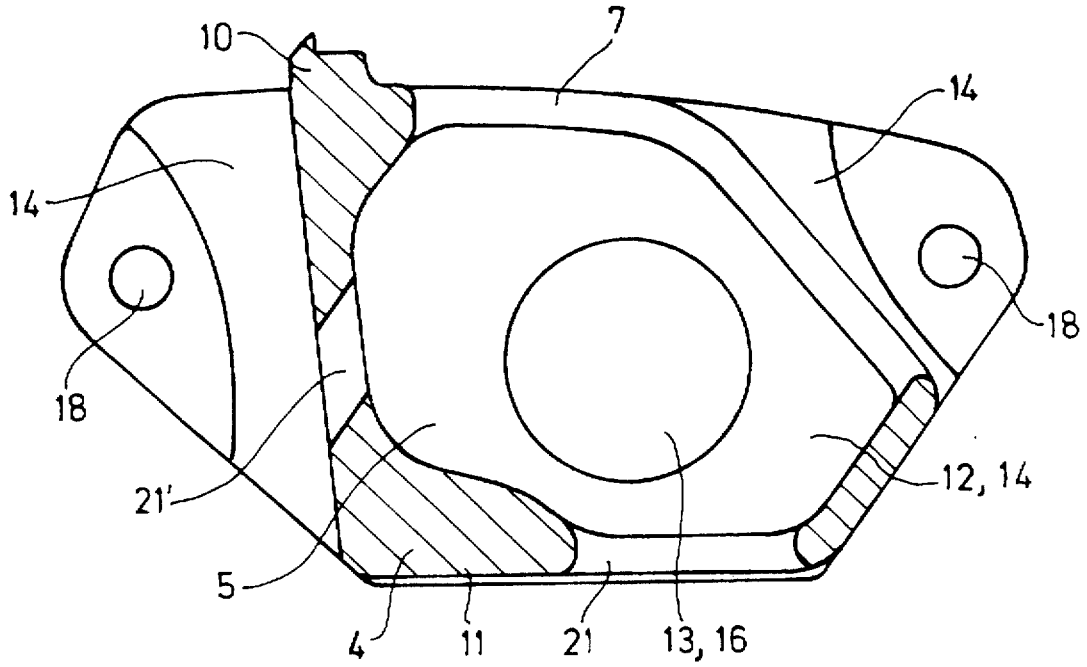
FIG. 3 is an enlarged cross-sectional view of FIG. 2 showing the hollow profile of the gripper bar in the region of a gripper.
Figure 4:
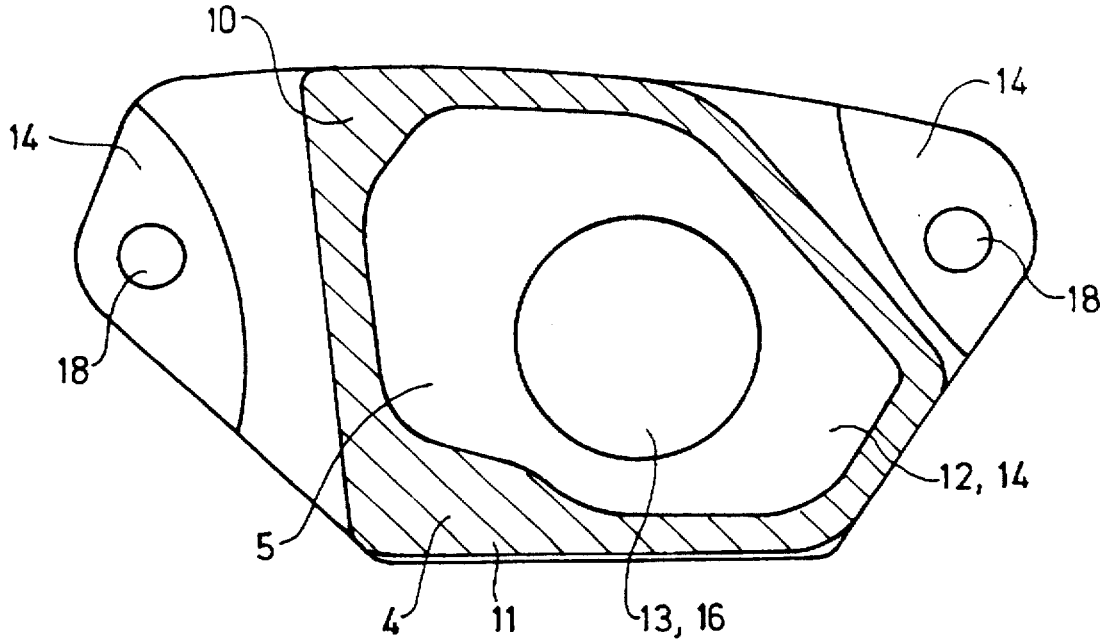
FIG. 4 is an enlarged cross-sectional view of FIG. 2 showing the hollow profile of the gripper bar in another region thereof.

In FIGS. 3 and 4, the basic body of the gripper bar 1 is shown.

FIG. 3 shows a section through the hollow profile 4 in the region of the gripper 3. Identical reference numerals match those described hereinbefore. The bores 18 serve for the threaded fastener 17 to fasten the connecting elements 15 for suspending the gripper bar 1 on the transport chains 2. The wall 12 or 14 may be either a transverse wall 12 or a shell-like flange 14; a bore 13 is formed in the transverse wall 12 so that the gripper shaft 6 can be passed through it. However, bearings 16 which serve to receive the gripper shaft 6 may be provided either in a transverse wall 12 or in a shell-like flange 14 or both.

FIG. 4 shows the hollow profile 4 in a different region, once again in section. No grippers 3 are located in this region, and therefore the hollow profile can be embodied with a closed box shape.

We claim:

1. A gripper bar assembly for a delivery of a printing press, comprising:

a gripper bar carried at respective ends thereof by transport chains, said gripper bar carrying a multiplicity of grippers with gripper fingers for transporting sheets and having a hollow profiled member with a boxlike profile;

a gripper shaft received in said hollow profiled member;

gripper pads disposed on an upper side of the hollow profiled member;

said hollow profiled member being formed with lateral openings through which the gripper fingers of the grippers extend;

said hollow profiled member having a thickened wall segment supporting said gripper pads, a relatively thinner wall segment adjacent said thickened wall segment, a further thickened wall segment adjacent said relatively thinner wall segment, and a further relatively thinner wall segment distally from said gripper pads and adjacent said further thickened wall segment.

2. The gripper bar assembly according to claim 1, wherein the hollow profiled member is formed with varying wall thicknesses over the length.

3. The gripper bar assembly according to claim 2, wherein the wall thickness of the hollow profiled member is thinner in the middle of the gripper bar than in the vicinity of the ends thereof.

4. The gripper bar assembly according to claim 1, wherein the hollow profiled member has at least one transverse wall formed with a through-bore therein for a gripper shaft.

5. The gripper bar assembly according to claim 1, wherein the hollow profiled member has, at the ends thereof, flanges to which connecting elements for connecting the gripper bar to the transport chains are attached, and including bearings for the gripper shaft received in said flanges.

6. The gripper bar assembly according to claim 1, wherein the hollow profiled member is formed with lateral openings for assembly and adjustment work.

* * * * *